United States Patent [19]

Brightbill et al.

[11] Patent Number: 4,800,906

[45] Date of Patent: Jan. 31, 1989

[54] WASHING APPARATUS

[75] Inventors: Jerry D. Brightbill; Kenneth M. Johnson, both of Norman, Okla.

[73] Assignee: Alco Foodservice Equipment Company, Miami, Fla.

[21] Appl. No.: 891,608

[22] Filed: Aug. 1, 1986

[51] Int. Cl.[4] ..... B08B 3/02

[52] U.S. Cl. ..... 134/56 R; 134/96; 134/107; 134/178; 134/198; 137/119; 239/69; 239/332; 239/445

[58] Field of Search ..... 134/94, 96, 99, 107, 134/115, 174, 178, 198, 56 R; 137/569, 624.27, 861, 883, 119; 239/59, 255, 278, 310, 330, 331, 372, 400.5, 485, 481, 68, 69, 332, 445, 444, 553, 553.3, 562, 565, 575, 625.1, 625.42, 627.5, 630.16, 594; 219/297, 310, 373, 380

[56] References Cited

U.S. PATENT DOCUMENTS

| | | | |
|---|---|---|---|
| 1,820,316 | 8/1931 | Miller | 239/444 X |
| 1,975,311 | 10/1934 | Creveling | 222/255 X |
| 1,990,524 | 2/1935 | Bystricky | 222/255 |
| 2,538,806 | 1/1951 | St. Clair | 222/59 |
| 2,665,772 | 1/1954 | Greer et al. | 134/96 X |
| 2,945,445 | 7/1960 | Smith et al. | 222/255 X |
| 3,908,592 | 9/1975 | Ordway et al. | 239/67 |
| 4,442,975 | 4/1984 | Long et al. | 239/444 X |
| 4,651,788 | 3/1987 | Grosskreuz et al. | 222/485 X |

OTHER PUBLICATIONS

Hurricorp/Alco 1986 HurriWasher ®720 Service Manual (1986).

*Primary Examiner*—Timothy F. Simone
*Assistant Examiner*—Frankie L. Stinson
*Attorney, Agent, or Firm*—Laney, Dougherty, Hessin & Beavers

[57] ABSTRACT

A washing apparatus for providing a fluid such as hot water to either a spray nozzle or a dishwasher. A thermostatically controlled heated water storage tank supplies fluid to a piping system having a first branch and a second branch. The first branch is directed to the inlet of a pumping system which pumps hot water to a first outlet of the apparatus. The first branch also includes a bypass line. The second branch of the piping system is directed toward a second outlet of the apparatus and includes a flow sensing switch. The first outlet is adapted for connection to a spray wand having a high pressure nozzle therein for supplying high pressure sprayed fluid as desired. The second outlet is adapted for connection to a dishwasher having a solenoid controlled inlet valve. As long as the dishwasher is not running, the pumping system and spray wand may be used normally. If the dishwasher is turned on, the flow sensing switch, which is connected to the control circuitry of the motor driving the pumping system, senses the flow in the second piping branch and shuts off power to the pumping system motor. In this way, the dishwasher has priority over the spray wand, and adequate fluid flow to the dishwasher is insured.

5 Claims, 2 Drawing Sheets

WASHING APPARATUS

BACKGROUND OF THE INVENTION

1. Field of the Invention

This invention relates to hot fluid washing apparatus, and more particularly, to a washer having a first outlet connectable to a spray nozzle and a second outlet connectable to a dishwasher, or other device requiring a heated fluid, and further having a flow switch for sensing fluid flow through the second outlet to the dishwasher.

2. Description Of The Prior Art

A previously known hot fluid washing unit is the HurriWasher® Model 720 manufactured by the assignee of the present invention. This apparatus includes a thermostatically controlled heated fluid storage tank with a pumping system for pumping a fluid, such a hot water, from the tank through a high pressure nozzle in a hand-operated spray wand. The apparatus also includes a fluid shut-off valve and an inlet strainer in the line between the heated tank and the pumping system. A bypass system is provided so that fluid will bypass around the pump when the pumping system is turned on and the spray wand is closed off. The heated tank has a low fluid level cutoff for stopping the heating system and also includes a temperature/pressure relief valve. The pump outlet also includes a pulsation damper. Indicator lights are provided for showing when the heating and pumping systems are switched on.

This apparatus has been used successfully for spray-washing situations. However, there is a need for an apparatus which will provide heated fluid to a dishwasher or other hot fluid consuming device as well as to the hand-operated spray wand. A problem with simply connecting a dishwasher to the heated tank is that there is a possibility that sufficient fluid flow may not be available to the dishwasher when the spray wand is in use. The present invention solves this problem by providing a modification of the previous washer having a connection to a dishwasher in which a flow-sensing switch is used to shut off power to the pumping system when the dishwasher is in use.

SUMMARY OF THE INVENTION

The washing apparatus of the present invention comprises heated fluid storage means, flow passageway means in communication with the heated fluid storage means, power operated pumping means having an inlet in communication with the flow passageway means for pumping fluid out of the heated fluid storage means through a first portion of the flow passageway means, first outlet means in communication with an outlet of the pumping means, second outlet means in communication with a second portion of the flow passageway means, and control means for sensing fluid flow in the second portion of the flow passageway means and preventing operation of the pumping means when the fluid flow is sensed.

The flow passageway means includes a piping system comprising a tee connected to the heated fluid storage means, a first piping branch connecting a first run opening of the tee to the pumping means, and a second piping branch connecting a second run opening of the tee to the second outlet means. The first piping branch preferably comprises a flow control valve and an inlet strainer. The control means preferably comprises a flow switch disposed in the second piping branch.

In the preferred embodiment, the flow passageway means further comprises bypass means for bypassing fluid around the pumping means when the fluid pressure at the pumping means outlet exceeds a predetermined level.

The heated fluid storage means is best characterized by a hot water storage tank having thermostatically controlled heating means and low water cutoff means therein.

The heated fluid storage means, flow passageway means, power operated pumping means and control means are all enclosed in an outer housing. Control switches and indicator lights are provided for both the heating means and pumping means. The first outlet means opens externally of the housing and is adapted for connection to a spray nozzle, and the second outlet means also opens externally of the housing and is adapted for connection to a dishwasher having a solenoid controlled inlet valve or other device requiring heated fluid.

The pumping means is used to pump hot fluid from the storage tank to the first outlet means and spray nozzle. When the dishwasher is operating, flow through the second portion of the flow passageway means to the second outlet means is sensed by the control means such that the pumping means is turned off. In this way, adequate water supply is always insured for the dishwasher.

An important of the present invention is to provide a washing apparatus adapted for supplying hot fluid to a spray nozzle and a device which consumes heated fluid, such as a dishwasher.

Another object of the invention is to provide a washing apparatus having a fluid flow sensing control means for sensing flow in a portion of a piping system for preventing operation of a pump used to pump fluid through another portion of the piping system.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
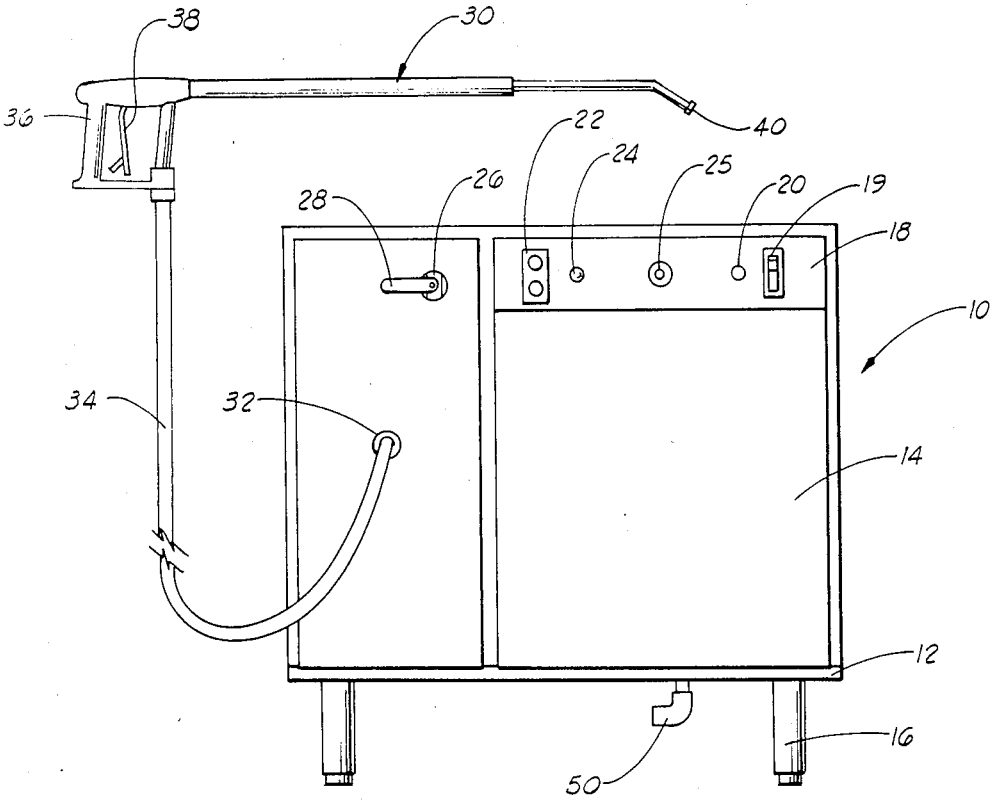
FIG. 1 is a front elevation view of the washing apparatus of the present invention with a spray wand attached to a first outlet thereof.

Referring now to the drawings, and more particularly to FIG. 1, the hot fluid washing apparatus of the present invention is shown and generally designated by the numeral 10. Washing apparatus 10 is designed for supplying a heated fluid, such as hot water, for washing operations. Apparatus 10 includes a frame 12 supporting an outer housing 14. Extending downwardly from frame 12 are a plurality of support legs 16.

Outer housing 14 includes a control panel 18 with a heater switch 19, heater indicator light 20, pump switch 22, pump indicator light 24 and resettable circuit breaker 25 thereon.

A fluid control valve 26 has a handle 28 extending from housing 14 for operation of the valve from the exterior of apparatus 10, as will be discussed in more detail hereinafter.

A hand-operated spray wand 30 is connected to a high pressure first fluid outlet 32 extending from housing 14 by means of a high pressure hose 34. Spray wand 30 includes a handle 36 with a trigger 38 adjacent thereto and a high pressure outlet nozzle 40.

Figure 2:
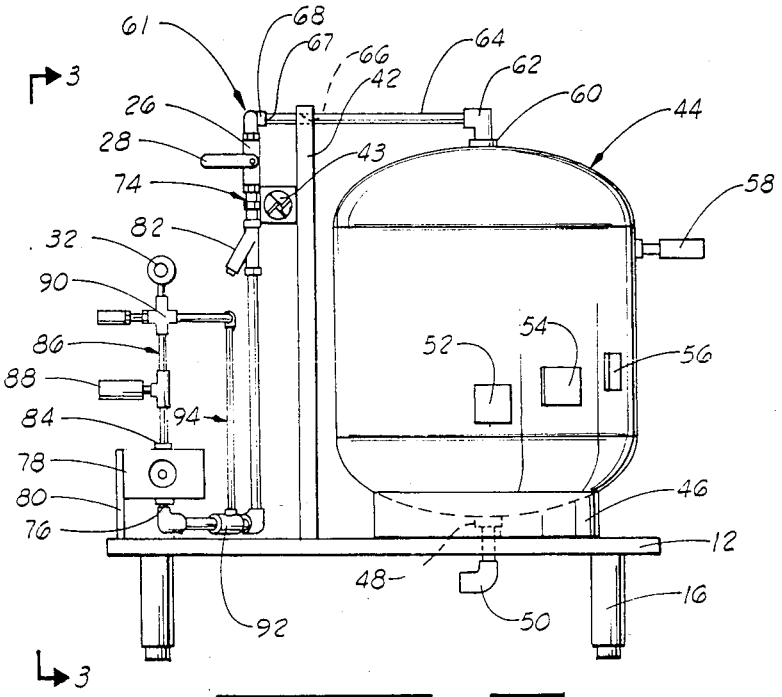
FIG. 2 is a front view of the apparatus with the outer housing removed and showing the pumping system.

Referring now to FIG. 2, housing 14 has been removed from washing apparatus 10 so that frame 12 is fully exposed. A central dividing wall 42 extends upwardly from frame 12. A cooling fan 43 for apparatus 10 is attached to dividing wall 42 adjacent the rear thereof.

As viewed in FIG. 2, a hot water storage tank 44 is disposed to the right of wall 42 and provides fluid storage means for apparatus 10. Tank 44 has a base portion 46, attached to frame 12, and an inlet opening 48 is included at the lower end of the tank. An inlet elbow 50 is connected to inlet opening 48 to provide a fluid inlet connection external of frame 12 and housing 14.

A plurality of thermostatically controlled heaters 52, 54 and 56 are provided for heating the fluid, such as water, contained in tank 44. A temperature/pressure relief valve 58 is connected to tank 44 to prevent overpressurization thereof by heating of the fluid therein.

A fluid outlet opening 60 is provided at the upper end of tank 44. A flow passageway means, generally designed by the numeral 61 and preferably in the form of a piping system, is provided in communication with outlet opening 60 of tank 44.

An elbow 62 is connected to outlet opening 60. A pipe 64 is connected to elbow 62 and extends therefrom in a direction toward dividing wall 42 and through a hole 66 in the dividing wall, forming a tank discharge line.

Figure 3:
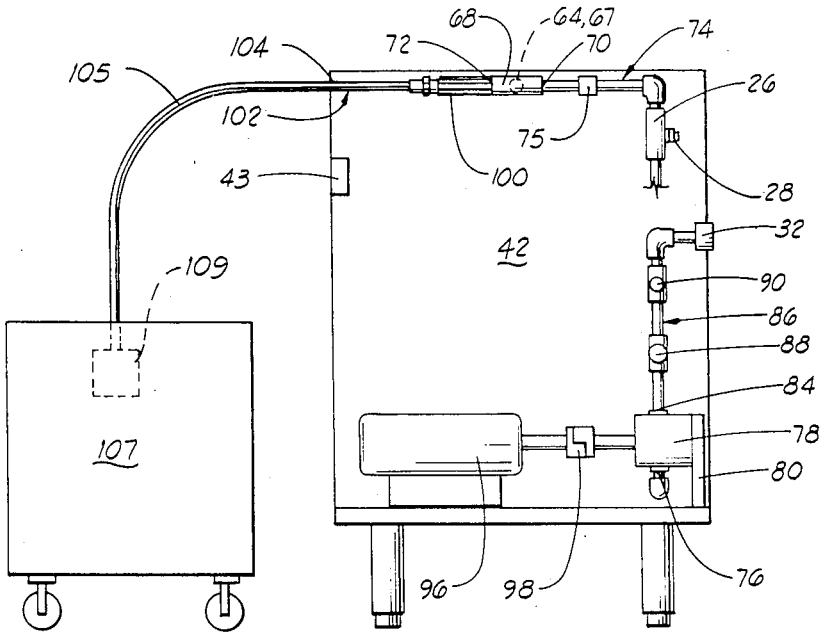
FIG. 3 is a side elevation view of the apparatus as viewed from lines 3—3 in FIG. 2.

Referring now also to FIG. 3, pipe 64 is connected to the cross opening 67 of a tee 68. First and second run openings of tee 68 are identified by numerals 70 and 72, respectively. A first portion or branch of flow passageway means 61 extends from first run opening 70, and a second portion or branch of the flow passageway means extends from second run opening 72.

A pump inlet line 74, forming part of the first branch, interconnects first run opening 70 of tee 68 with inlet 76 of a pump 78 which is attached to frame 12 by a bracket 80. Included in inlet line 74 are a check valve 75, the water control valve 26, previously mentioned, and an inlet strainer 82. High pressure first outlet 32 of washing apparatus 10 is interconnected with pump outlet 84 by a pump outlet line 86. Included in outlet line 86 is a pulsation damper 88 and an unloader valve 90. Interconnecting unloader valve 90, and thus outlet line 86, with tee 92 in inlet line 74 is a bypass line 94. The operation of unloader valve 90 and bypass line 94 will be further described herein.

Referring now to FIG. 3, pump 78 is power driven by a motor 96 through a standard coupling 98. Electric motor 96 is electrically connected to pump switch 22 as hereinafter described.

A normally closed flow control switch 100 is connected to second run opening 72 of tee 68. Flow switch 100 forms a portion of a dishwasher inlet line 102 which also defines a second outlet 104 of washing apparatus 10. Dishwasher inlet line 102 thus forms the second branch of flow passageway means 61. Flow switch 100 is electrically connected to the wiring circuitry controlling electric motor 96, as hereinafter described in detail. Outlet 104 is connected to pipe 105 which is connected to a dishwasher 107. The pipe 105 contains a solenoid valve 109 which opens in a conventional fashion in response to a signal from the dishwasher 107 at the time when the dishwasher enters the rinse cycle.

Figure 4:
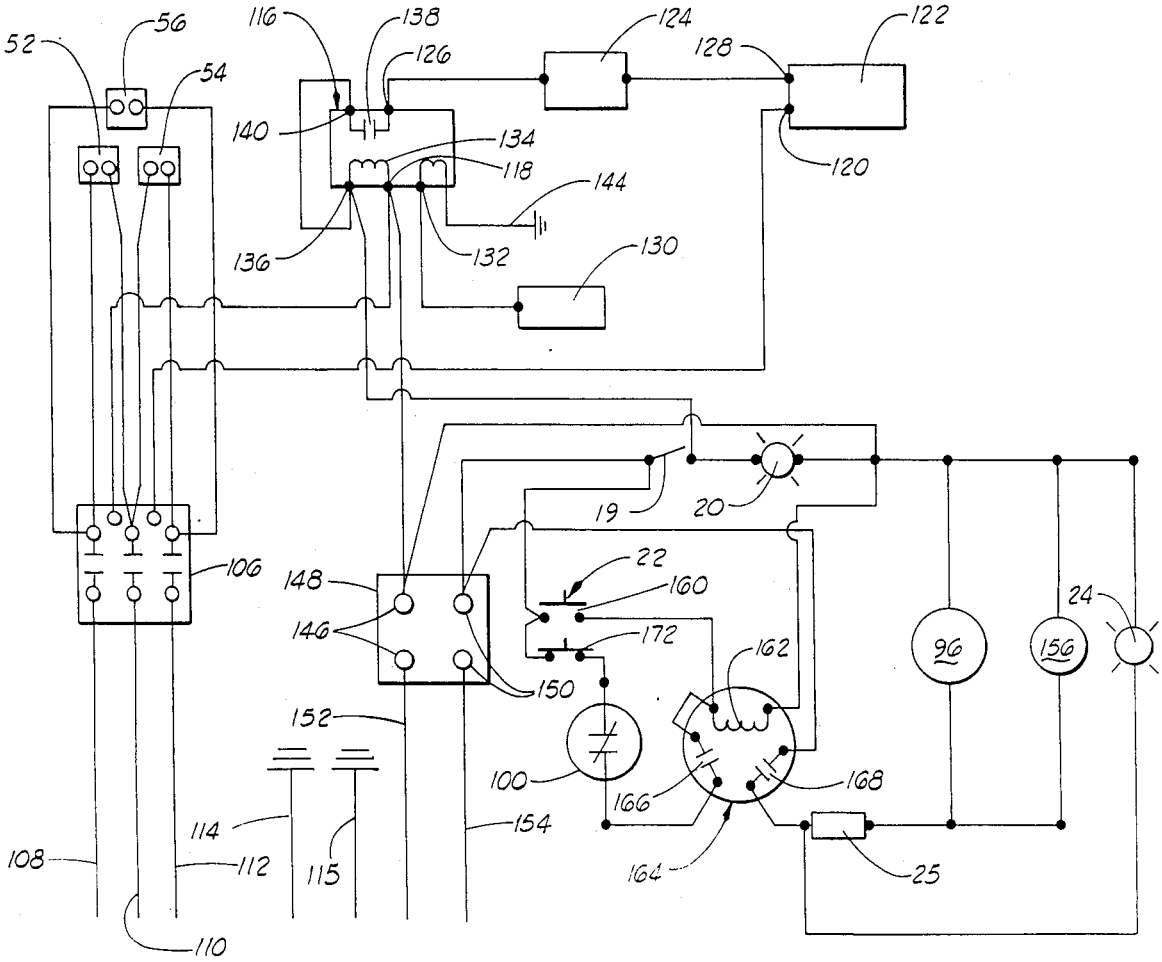
FIG. 4 shows a wiring schematic for the washing apparatus of the present invention.

Referring now to FIG. 4, a wiring schematic of washing apparatus 10 is disclosed. An electrical contactor 106 is connected to heater elements 52, 54 and 56. Three-phase current is supplied to contactor 106 by lines 108, 110 and 112. A three-phase ground 114 is provided for apparatus 10, and a single-phase ground 115 is also provided.

A low water cutoff circuit board 116 of a kind known in the art has a terminal 118 connected to contactor 106. A first terminal 120 of a thermostat 122 is also connected to contactor 106. A high limit electrical cutoff switch 124 interconnects terminal 126 of the water cutoff circuit board 116 and a second terminal 128 of thermostat 122. A low water cutoff probe 130 is connected to terminal 132 of low water cutoff circuit board 116. A relay coil 134 is wired across terminals 118 and 136. A relay 138, controlled by coil 134, is connected across terminals 126 and 140. Terminals 136 and 140 are interconnected. Terminal 132 is wired to ground 144.

Thermostat 122 and high limit electrical cutoff switch 124 will de-energize coil 134, opening relay 138 and shutting off heaters 52, 54 and 56, when the fluid temperature in tank 44 exceeds a predetermined level. Similarly, low water cutoff probe 130 will shut off the heaters if the tank water level drops below a predetermined level.

Terminal 118 of low water cutoff circuit board 116 is connected to a first set of neutral terminals 146 of a terminal block 148. Terminal block 148 also has a second set of power terminals 150. First and second terminals 146 and 150 are connected to neutral line 152 and power line 154, respectively, which preferably provide single-phase, 120-volt power to terminal block 148.

Connected to first terminals 146 of terminal block 148 are first legs of pump motor 96, fan motor 156 driving fan 43, pump indicator light 24 and heater indicator light 20.

The other leg of heater indicator light 20 is connected to a side of manually controlled heater switch 19. The other side of heater switch 19 is in turn connected to second terminals 150 of terminal block 148.

Connected to terminal block 150 is pump switch 22 which preferably is of the on-off push button type. ON button 160 of pump switch 22 is connected to second terminals 150 of terminal block 148 and a side of coil 162 of relay 164. The other side of coil 162 is in electrical communication with the first legs of pump motor 96, fan motor 156 and pump indicator light 24 and thus also in communication with first terminal 146 of terminal block 148. Coil 162 controls two contacts 166 and 168 which in turn start pump motor 96 and fan motor 156. Circuit breaker 25 interconnects the second legs of pump motor 96 and fan motor 156 with contact 168. When momentary contact ON button 160 is pushed, coil 162 is energized to close contacts 166 and 168. As is known in the art, coil 162 will remain energized after ON button 160 is released.

OFF button 172 of pump switch 22 is also connected to second terminals 150 of terminal block 148 and is used to interrupt the power to coil 162 in relay 164, thus opening contacts 166 and 168 for stopping pump motor 96 and fan motor 156 in a manner also known in the art.

Flow switch 100 is wired between OFF button 172 and relay 164. Flow switch 100 is preferably a normally closed switch 100 which, when closed, allows pump switch 22 to operate in a normal manner. When flow switch 100 is opened, it will be seen that pump motor 96 and fan motor 156 will be shut off just as if OFF circuit 172 of pump switch 22 had been actuated.

OPERATION OF THE APPARATUS

A fluid supply line (not shown) is connected to inlet elbow 50 to provide fluid to storage tank 44. A fluid connection (also not shown) is made between second outlet 104 of apparatus 10 and a solenoid inlet valve on a typical dishwasher as hereinbefore mentioned.

To operate the apparatus, heater switch 19 is turned on to heat the water in storage tank 44. After the water has reached the desired temperature, water may be provided to either the dishwasher 107 or to spray wand 30.

If it is desired to use spray wand 30, water control valve 26 is opened by turning handle 28, and motor 96 driving pump 78 is turned on by pump switch 22. As long as trigger 38 of spray wand 30 is not actuated, nozzle 40 will be shut off so that water will bypass through unloader 90 and bypass line 94. Unloader 90 is designed to bypass when the pressure at outlet 84 of pump 78 exceeds a predetermined level. Thus, bypass means for the pumping system are provided. When trigger 38 is actuated, high pressure fluid will be discharged through nozzle 40 of spray wand 30 in a manner known in the art.

When the dishwasher 107 is turned on, the inlet solenoid valve 109 thereof will be energized and opened so that fluid may be provided thereto from storage tank 44 through dishwasher inlet line 102. As soon as fluid flow starts through dishwasher inlet line 102, this flow will be detected by flow switch 100 which will in turn be moved to an open position, acting as a control means for shutting off pump motor 96 and thus cutting off fluid flow to spray wand 30. As already described herein, flow switch 100 will also shut off power to fan motor 156. When this power cutoff occurs, pump indicator light 24 also will be turned off.

Thus, as long as the dishwasher is turned on and is drawing fluid from storage tank 44 through dishwasher inlet line 102, restarting of pump motor 96 is impossible because flow switch 100 is still open. In this way, the fluid demand of the dishwasher has priority over operation of spray wand 30. Because the use of spray wand 30 is prevented, the problem of inadequate flow of hot water to the dishwasher, and thus potential damage thereto, is prevented.

It will be seen, therefore, that the hot fluid washing apparatus of the present invention is well adapted to carry out the ends and advantages mentioned, as well as those inherent therein. While a presently preferred embodiment of the invention has been described for the purposes of this disclosure, numerous changes in the arrangement and construction of parts may be made by those skilled in the art. For example, where a relatively larger capacity water tank 44 with greater heating capacity is provided, sufficient hot water is developed at sufficient pressure to supply both the spray wand 30 and the dishwasher 107 demand simultaneously. In this embodiment the switch 100 is simply removed from the circuit, and thus does not function to prevent operation of the pump 96 at this time. All such changes are encompassed within the scope and spirit of the appended claims.

What is claimed is:

1. A washing apparatus comprising:

heated fluid storage means;

flow passageway means in communication with said heated fluid storage means, said flow passageway means including a first portion and a second portion;

power operated pumping means having an inlet in communication with said flow passageway means for pumping fluid out of said heated fluid storage means through a first portion of said flow passageway means, said power operated pumping means further having an outlet;

first outlet means in communication with said outlet of said pumping means and adapted for connection to a spray nozzle;

second outlet means in communication with said second portion of said flow passageway means and adapted for connection to a dishwasher having a solenoid controlled inlet valve; and control means for sensing fluid flow in said second portion of said flow passageway means and preventing operation of said pumping means when said fluid flow is sensed in said second portion of said flow passageway means.

2. A hot water washing apparatus comprising:

a heated storage tank;

a motor driven pump adjacent said tank and having an inlet and an outlet;

a tank discharge line in fluid communication with said tank, said tank discharge line comprising:

a first branch connected to said inlet of said pump and including a flow control valve wherein said pump is used to pump water from said tank through a first water outlet in communication with said pump outlet; and a second branch including a flow switch therein responsive to fluid flow through said second branch, said flow switch being electrically connected to said motor, such that said motor is prevented from driving said pump when there is fluid flow from said tank through said second branch toward a second water outlet in fluid communication with said flow switch.

3. The apparatus of claim 2 wherein said flow switch is a normally closed flow switch.

4. The apparatus of claim 2 further comprising a bypass line interconnecting said pump outlet with said first branch and including an unloader valve for allowing fluid flow thereby when a pressure of said pump outlet exceeds a predetermined level.

5. The apparatus of claim 2 further comprising a spray wand connected to said first water outlet.

* * * * *